US010342727B2

(12) United States Patent
Thorn

(10) Patent No.: US 10,342,727 B2
(45) Date of Patent: Jul. 9, 2019

(54) METHOD OF MASSAGING USING A MASSAGE TOOL

(71) Applicant: Jonathan Thorn, Castro Valley, CA (US)

(72) Inventor: Jonathan Thorn, Castro Valley, CA (US)

( * ) Notice: Subject to any disclaimer, the term of this patent is extended or adjusted under 35 U.S.C. 154(b) by 408 days.

(21) Appl. No.: 14/606,906

(22) Filed: Jan. 27, 2015

(65) Prior Publication Data

US 2016/0213564 A1 Jul. 28, 2016

(51) Int. Cl.
*A61H 7/00* (2006.01)
*A61H 11/00* (2006.01)

(52) U.S. Cl.
CPC ..... *A61H 7/001* (2013.01); *A61H 7/003* (2013.01); *A61H 11/00* (2013.01); *A61H 2201/0153* (2013.01); *A61H 2201/164* (2013.01); *A61H 2201/1635* (2013.01)

(58) Field of Classification Search
CPC ..... A61H 7/001; A61H 7/002; A61H 7/003; A61H 7/004; A61H 7/005; A61H 7/007; A61H 11/00; A61H 39/00; A61H 2201/1057; A61H 2201/1253; A61H 2201/1635; A61H 2201/1638; A61H 2201/1645; A61H 2201/1676; A61H 2201/1671; A61H 2201/5017; A61H 2011/005; A61H 31/007; A61H 1/02; A61H 1/0237; A61H 1/0274; A61H 2205/06; A61H 1/008; A61H 2201/0153
See application file for complete search history.

(56) References Cited

U.S. PATENT DOCUMENTS

| | | | | | |
|---|---|---|---|---|---|
| 655,490 | A | | 8/1900 | Hollem | |
| 923,158 | A | | 6/1909 | Egan | |
| D40,158 | S | | 7/1909 | Apfel | |
| 1,058,273 | A | | 4/1913 | Thompson | |
| 1,233,537 | A | * | 7/1917 | Ahlman | A61B 5/4824 600/557 |
| 1,815,560 | A | | 7/1931 | Gehm | |
| D85,076 | S | | 9/1931 | Barker | |
| 2,127,674 | A | | 8/1938 | Clarke | |
| 3,957,039 | A | * | 5/1976 | Ehren | A61H 15/0092 601/119 |
| 3,996,929 | A | | 12/1976 | Mabuchi | |
| 4,557,262 | A | * | 12/1985 | Snow | A61B 17/132 606/201 |
| 4,770,164 | A | * | 9/1988 | Lach | A61H 31/005 601/41 |
| 4,944,747 | A | * | 7/1990 | Newth | A61H 39/04 601/135 |
| 5,117,815 | A | | 6/1992 | Gentry et al. | |
| 5,342,388 | A | * | 8/1994 | Toller | A61B 17/132 601/134 |

(Continued)

*Primary Examiner* — Valerie L Woodward
(74) *Attorney, Agent, or Firm* — Steven R. Vosen

(57) ABSTRACT

A method of massaging allows a user to use a massage tool to selectively apply pressure to an arm or leg. The massage tool includes a body having a curved surface, a strap and a handle. In the method, the strap is placed around the arm or leg, the strap is tightened, and a handle attached to the tool is moved. As a result of this method, the force of the curved surface of the tool may be accurately adjusted to provide for the release of tension in specific muscles.

11 Claims, 9 Drawing Sheets

(56) References Cited

U.S. PATENT DOCUMENTS 5,577,997 A * 11/1996 Thariani ..... A61H 7/003 601/135
D376,853 S 12/1996 Hsia
5,695,520 A * 12/1997 Bruckner ..... A61B 17/1325 606/201
5,709,647 A * 1/1998 Ferber ..... A61H 39/04 601/134
5,788,657 A * 8/1998 Burns ..... A61N 1/14 601/134
6,007,501 A * 12/1999 Cabados ..... A61H 39/04 601/131
6,102,876 A 8/2000 Winger
6,217,536 B1 * 4/2001 Gustafson ..... A61F 5/32 128/879
D463,029 S 9/2002 Collins
6,735,808 B2 5/2004 Chen
7,169,120 B2 1/2007 Murdock et al.
7,572,238 B2 8/2009 Rhoades
8,241,232 B2 8/2012 Sanders
8,262,593 B2 9/2012 Pidcock
8,727,955 B2 * 5/2014 Huang ..... A63B 21/0555 482/115
2006/0047228 A1 * 3/2006 Petelenz ..... A61H 31/007 601/41
2006/0069333 A1 * 3/2006 Pidcock ..... A61H 15/00 601/123
2006/0235344 A1 * 10/2006 Tu ..... A61H 7/00 601/135
2007/0129656 A1 * 6/2007 Brooks ..... A61H 7/003 601/135
2008/0161732 A1 * 7/2008 Cui ..... A61H 5/00 601/13
2009/0093741 A1 * 4/2009 Lach ..... A61H 31/005 601/41
2010/0094183 A1 * 4/2010 Golombek ..... A61H 7/001 601/112
2013/0237888 A1 9/2013 Weinstein
2014/0046227 A1 * 2/2014 Fleming ..... A61H 31/007 601/41
2015/0011921 A1 * 1/2015 Sidhu ..... A61H 7/001 601/134
2015/0018731 A1 * 1/2015 La Peer ..... A61H 39/04 601/135

* cited by examiner

METHOD OF MASSAGING USING A MASSAGE TOOL

BACKGROUND OF THE INVENTION

Field of the Invention

The present invention generally relates to a device and method of massaging, and more particularly to a device and method that person may use to massage their muscles.

Discussion of the Background

Massage is typically performed by applying pressure to the body of a patient, either manually or using a massage tool. Massage tools typically include some manner of surface or feature that is designed to contact the patient's body for the purpose of manipulating the patient's muscle tissue or connective tissue.

It is common for people to massage their own arms or legs to release tension in the muscles. When massaging one's own body, however, such as by applying pressure to one's own soft tissue, it is difficult to apply pressure to a trigger point (i.e. a muscle knot) without tensing the muscles.

A vast array of massage tools have been used in the past. Many previously-used tools are awkward to hold and thus difficult to use. In addition, such tools do not resolve the problem of the user tensing their own muscles to use the tools, and thus they are not as effective as they might be.

There is a need for a massage tool that is easy to manipulate, comfortable to hold, and which is versatile. There is also a need for a massage tool that a user may use to apply forces more selectively to specific parts of the body by pinpointing pressure and massage target areas with a minimal amount of effort by the user.

BRIEF SUMMARY OF THE INVENTION

The present invention overcomes the disadvantages of prior art by providing a method that allows a user to accurately apply a force to the body.

Certain aspects provide a method for massaging a user with a device that includes a handle, body including a surface, a strap, and a mechanism for adjusting the length of the strap. The method includes: placing the user between the body of the device and the strap, such that the strap and the body of the device surrounds the user; adjusting the length of the strip such that the surface is held against the user; and moving the handle to increase the force of the surface on the user.

Certain other aspects provide a method for massaging a user with a device that includes a handle, a body including a surface, a strap, and a mechanism for adjusting the length of the strap. The method includes: inserting the user between the surface and the strap, such that the strap and surface surrounds the user; pulling the end of the strap to tighten the strap and surface against the user; and moving the handle in a plane perpendicular to the user, such that the force on the user is adjusted.

These features together with the various ancillary provisions and features which will become apparent to those skilled in the art from the following detailed description, are attained by the method of massaging of the present invention, preferred embodiments thereof being shown with reference to the accompanying drawings, by way of example only, wherein:

BRIEF DESCRIPTION OF THE SEVERAL VIEWS OF THE DRAWING

FIG. 5A illustrates the positioning of the device on the user; FIG. 5B illustrates the tightening of the device on the user; and FIG. 5C illustrates the user of the device is massaging the user;

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
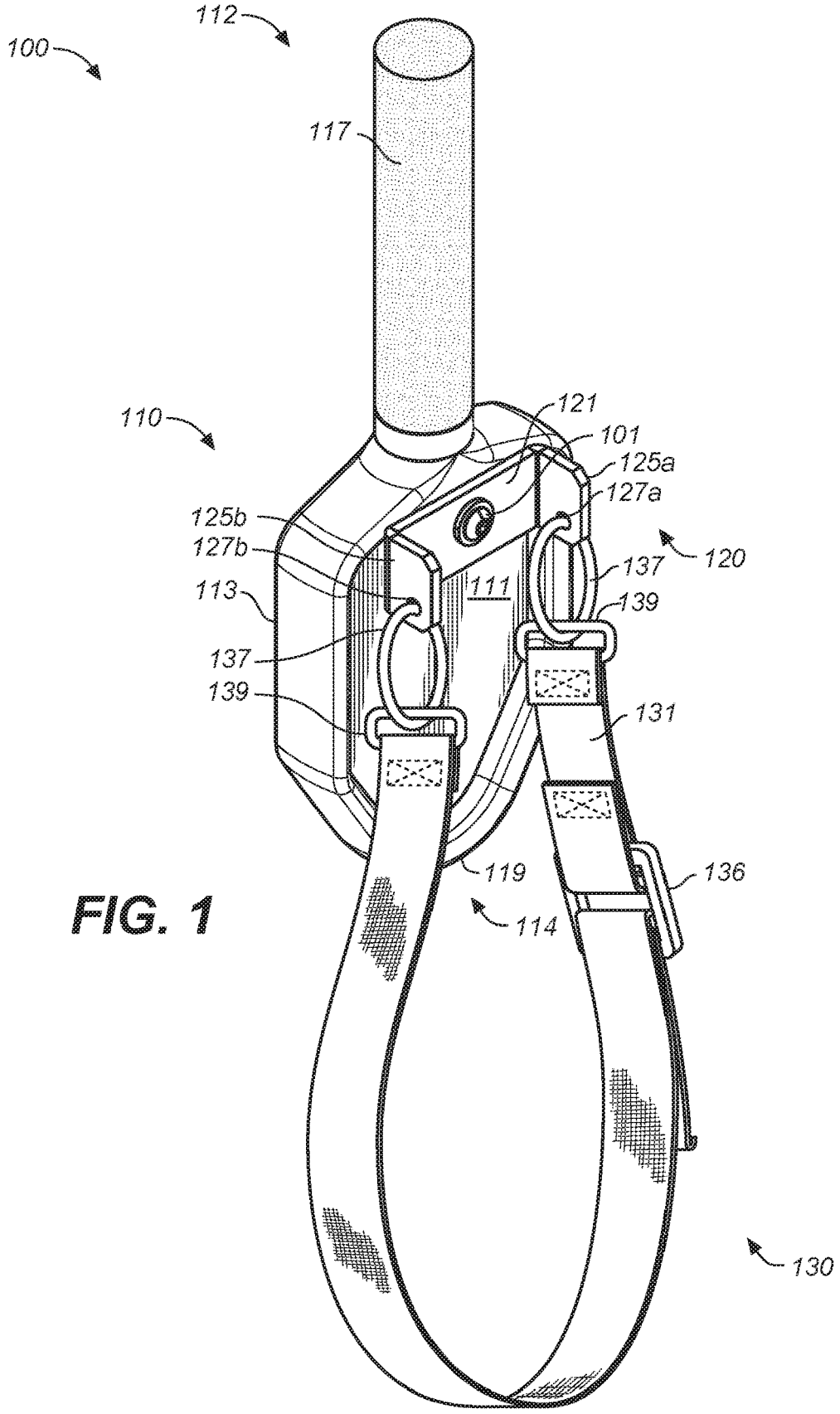
FIG. 1 is a front, side perspective view of a first embodiment device for massaging.
Figure 2:
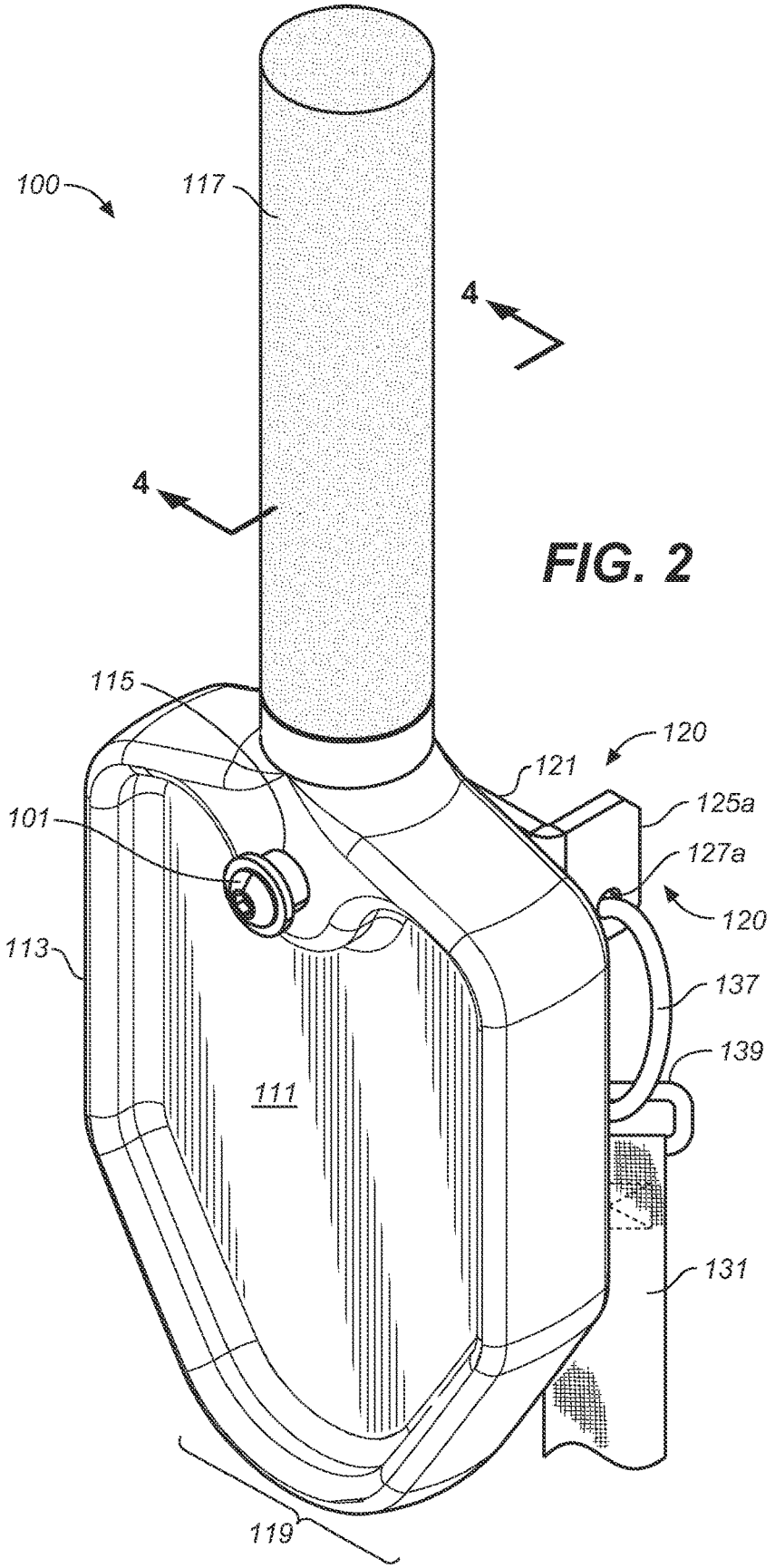
FIG. 2 is a back, side perspective view of the device of FIG. 1.
Figure 3:
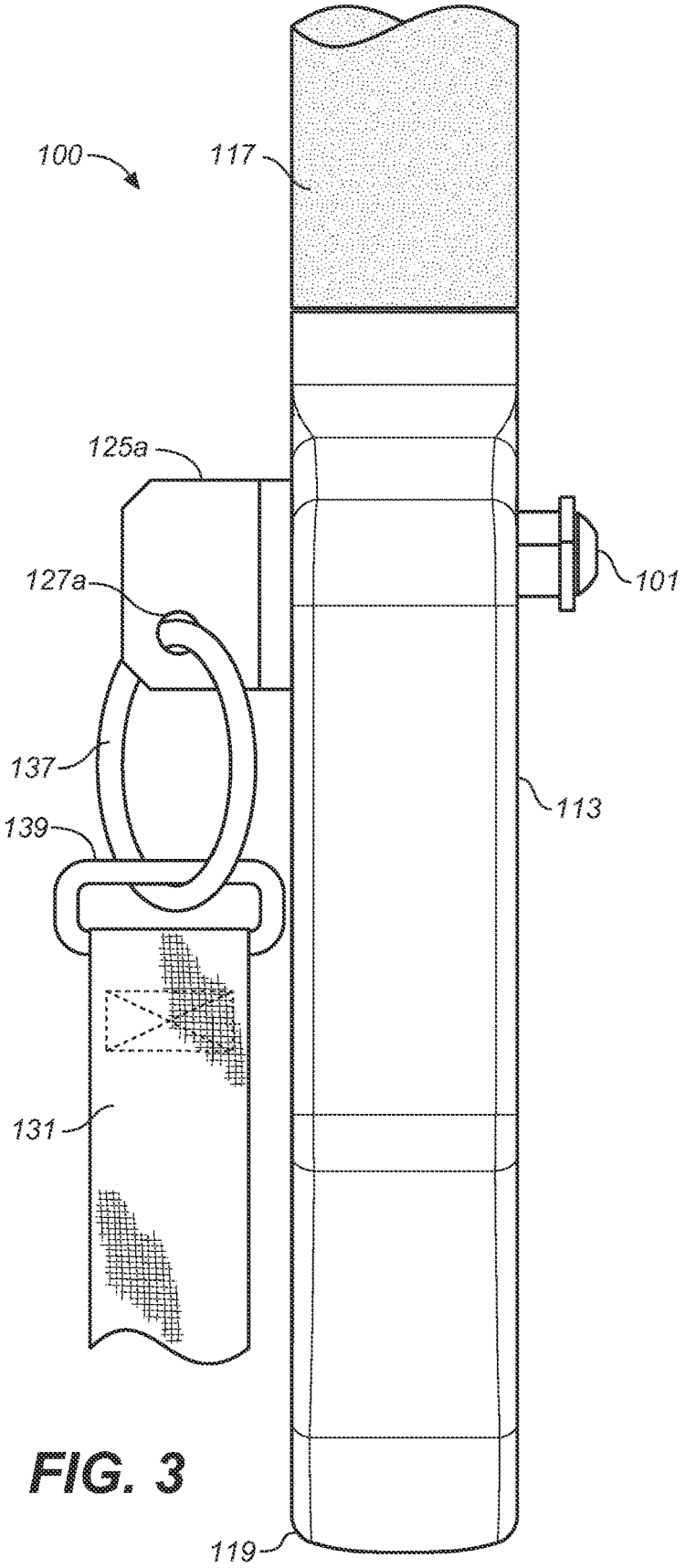
FIG. 3 is a side view of the device of FIG. 1.
Figure 4:
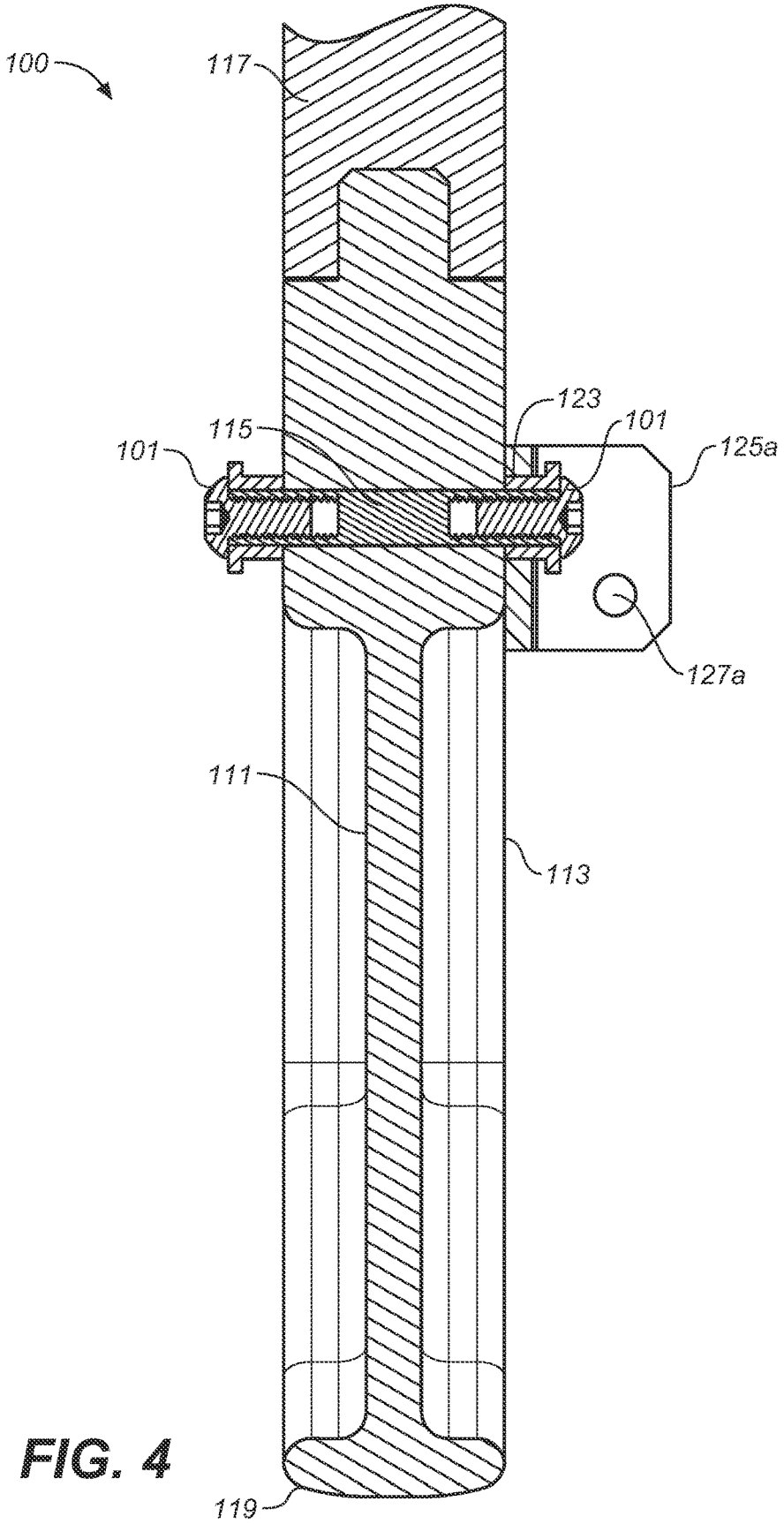
FIG. 4 is a sectional view 4-4 of FIG. 2.

The present invention allows a user to massage a muscle or location on their body with a desired force. A first embodiment of the device 100 is shown in FIGS. 1-4, where FIG. 1 is a front, side perspective view of the device, FIG. 2 is a back, side perspective view of the device, FIG. 3 is a side view of the device; FIG. 4 is a sectional view 4-4 of FIG. 1.

In one embodiment, device 100 includes a body 110, a bracket 120, and a restraining portion 130. Body 110, which has a proximal end 112 and a distal end 114, includes a plate 111 surrounded by a flange 113, and also includes a handle 117 at the proximal end and a curved surface 119 of the flange at distal end 114, which is best seen in FIG. 2.

Bracket 120 includes a flat portion 121, and a pair of flanges 125*a*, 125*b* each having corresponding holes 127*a*, 127*b*. In general, body 110 and bracket 120 are formed or joined together. FIGS. 1-4 illustrate one method of securing body 110 and bracket 120, where, as is shown most clearly in FIG. 4, the bracket is attached to the body by a bolt 101 that passes through a hole 123 in flat portion 121 and a hole 115 in flange 113.

Restraining portion 130 includes a strap 131 having a free end 134, pairs of interlocking rings 137 and 139 that attach the strap to holes 127*a* and 127*b*, and a buckle 136 that accepts the free end. Restraining portion 130 is thus attached to bracket 120 and has a length between holes 127*a* and 127*b* that may be adjusted by pulling or releasing free end 134.

In one embodiment, flange 113 and plate 111 are formed together by injection molding a plastic, such as Nylon or ABS. Handle 117 may also be injection molded with flange 113 and plate 111, or may be a separate piece that is attached to flange 113 by an adhesive or by otherwise fastening the parts together. In another embodiment, bracket 120 is formed from sheet metal, such as Aluminum or Steel or an injection molded plastic material, such as Nylon, ABS, or Polycarbonate. In other embodiments, strap 131 is formed from lengths of webbing, and buckle 136 is a strap adjuster buckle which is commonly used for adjusting the length of webbing straps.

In one embodiment, the width of the strap and the flange are approximately the same, and are 2 inches. In another embodiment, the length of strap 131 between rings 139 is from 36 inches to 48 inches. In yet another embodiment, the distance between proximal end 112 and distal end 113 of body 110 is from 9 inches to 12 inches.

The present invention allows a user to massage a muscle or location on their body with a desired force. A first embodiment of the device 100 is shown in FIGS. 1-4, where FIG. 1 is a front, side perspective view of the device, FIG. 2 is a back, side perspective view of the device, FIG. 3 is a side view of the device; FIG. 4 is a sectional view 4-4 of FIG. 2.

A first step of the method is to encircle strap 131 and body 110 about the user's appendage. Thus, for example and without limitation, FIG. 5A shows that a user may open the length of strap 131, as necessary, and place strap about an appendage A, such as an arm or a leg.

Figure 5A:
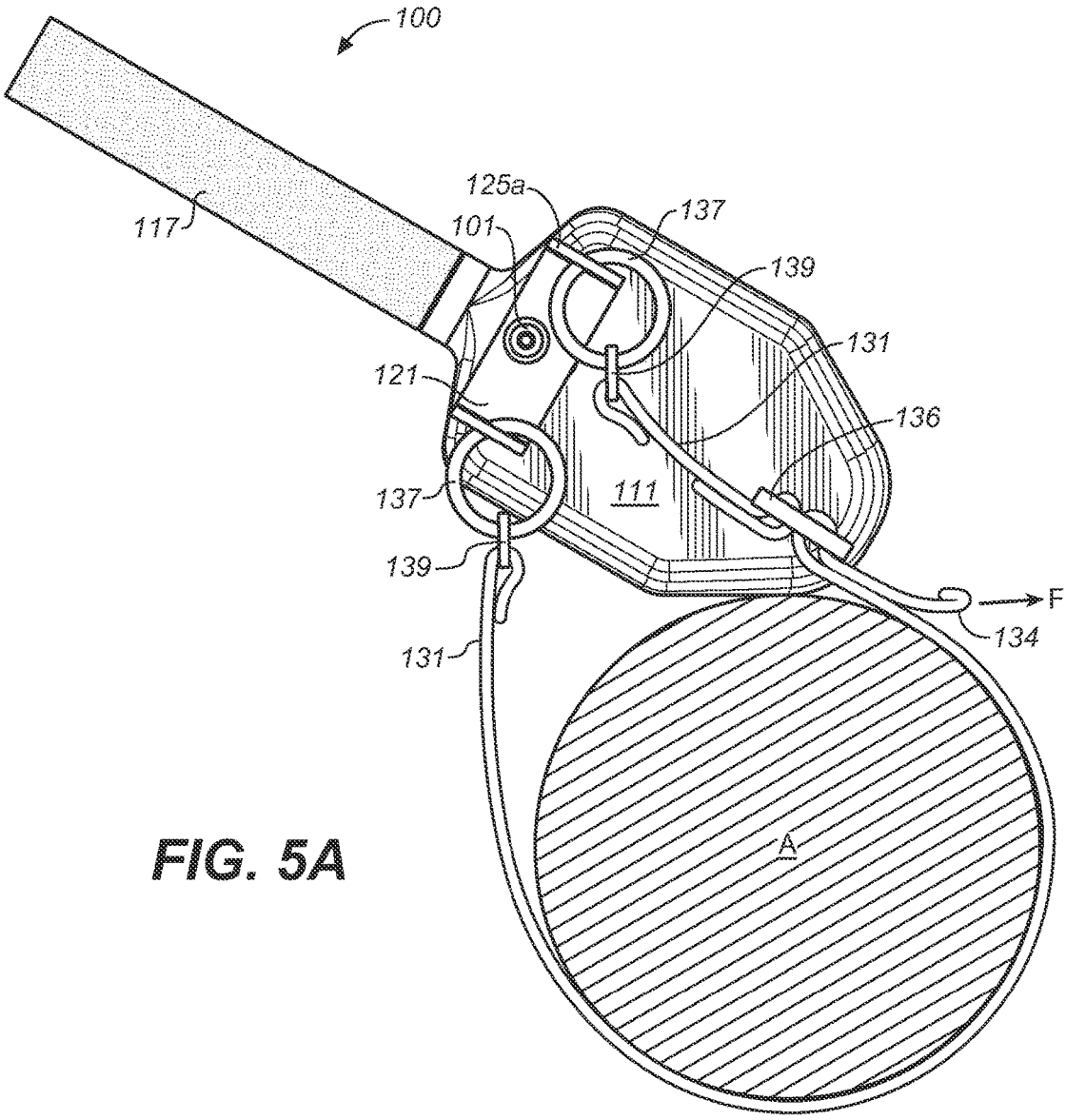
FIGS. 5A, 5B, and 5C are front views of a method of using the device of FIG. 1, where

In another embodiment, the step of FIG. 5A may include first removing the end 134 of strap 131 from the buckle 136, placing the strap over the appendage, and then inserting the end into the buckle.

Figure 5B:
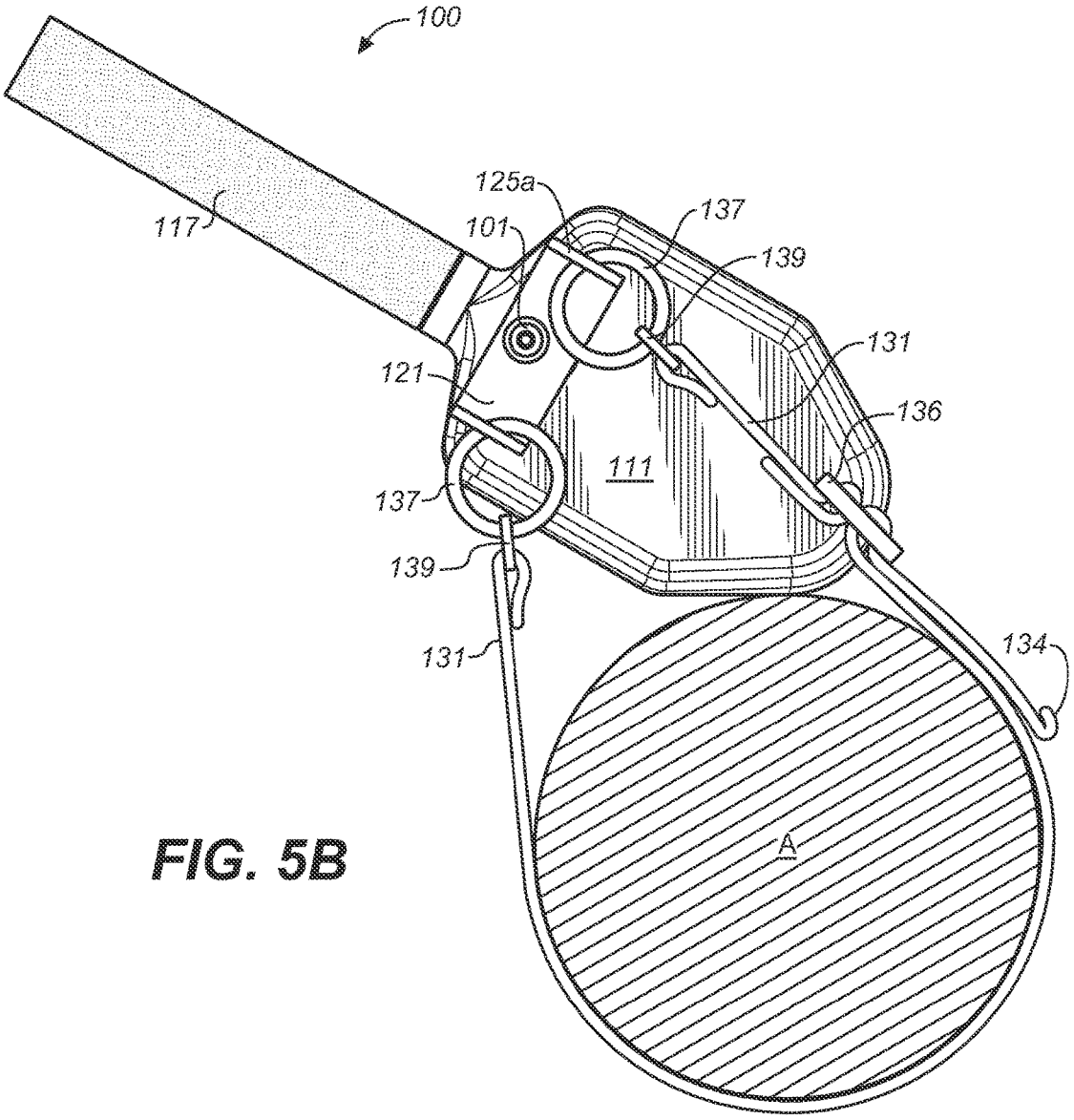

As is shown in FIG. 5B, flange 113 is then placed against appendage A, and end 134 of strap 131 is pulled to tighten restraining portion 130, thus forcing the flange against the appendage. Thus, for example, end 134 is pulled until curved surface 119 is snugly held against appendage A.

Figure 5C:
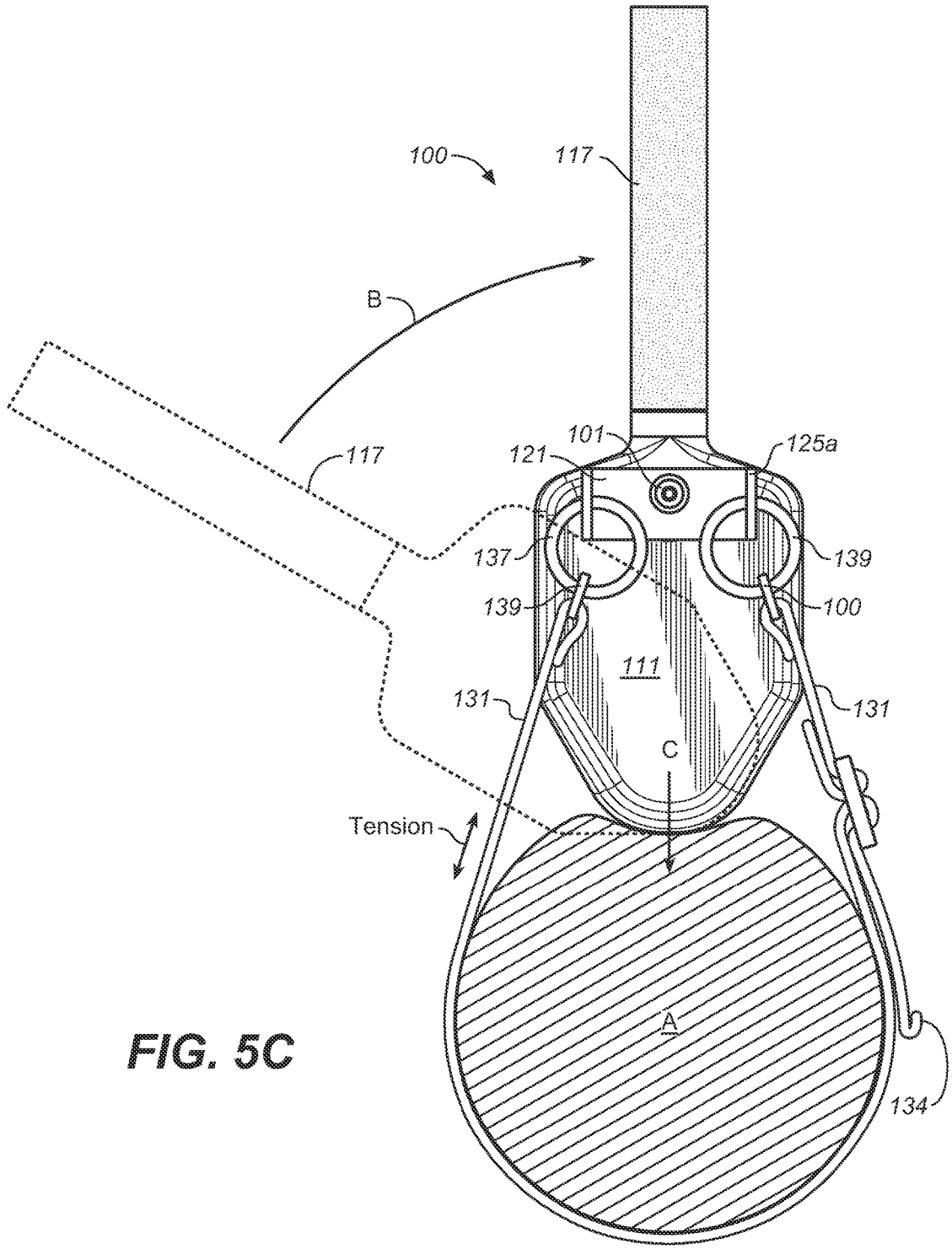

Next, as shown in FIG. 5C, the user may move handle 117, as shown by arrow B, causing the flange to contact and compress appendage A. Thus, for example, with no slippage of strap 131 or flange 113 on appendage A, the movement B of handle 117 rotates device 100 and results in a compressive force C on the appendage. It is preferred that it is the curved surface 119 of flange 113 that contacts appendage A, thus providing greater leverage of the applied force. The user may also rock handle 117 back and forth to adjust the compressive force C.

When the user is done massaging, the steps of FIGS. 5A-5C may be reversed and device 100 may be taken off of appendage A.

Figure 6:
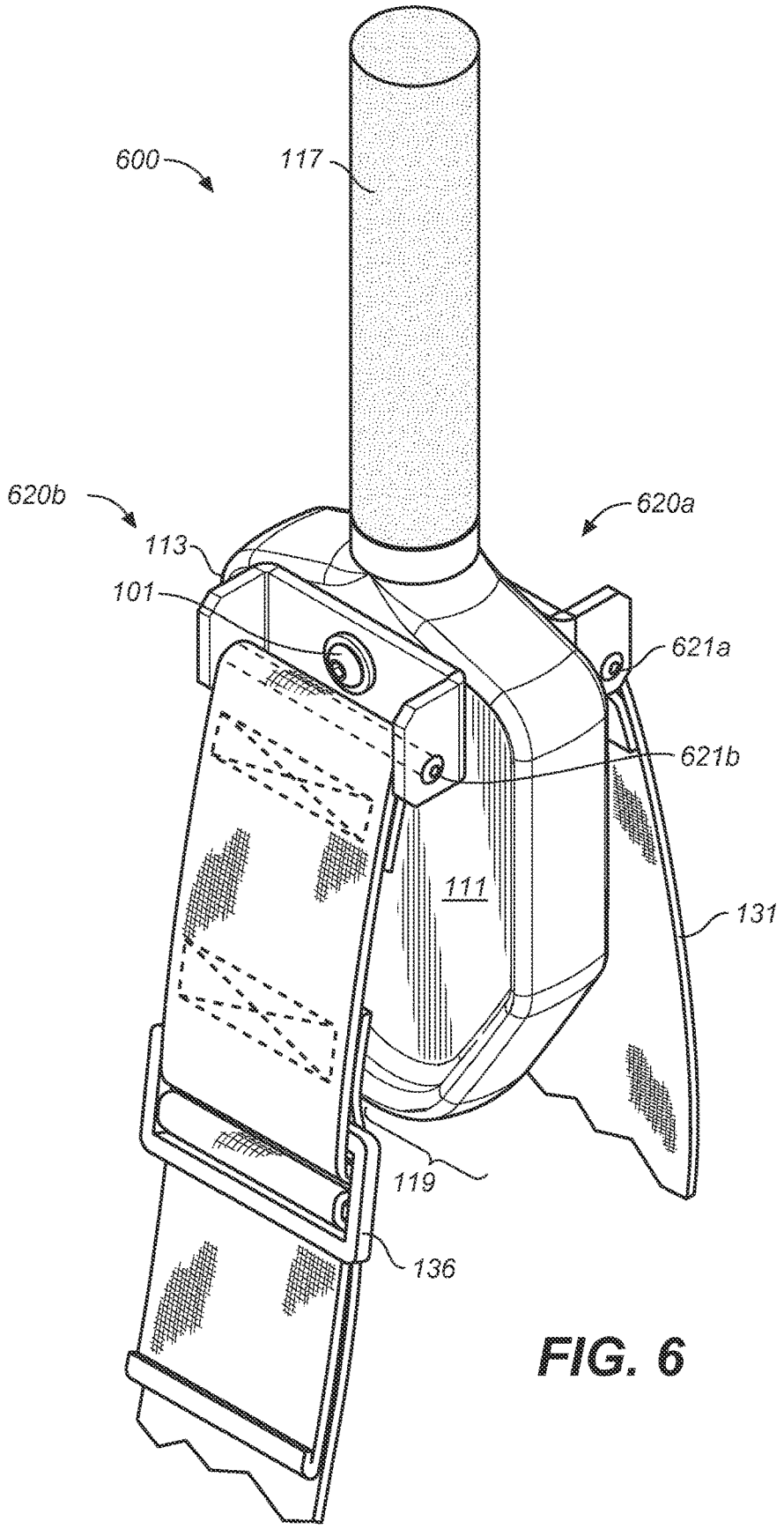
FIG. 6 is a back, side perspective view of a second embodiment device for massaging.
Figure 7:
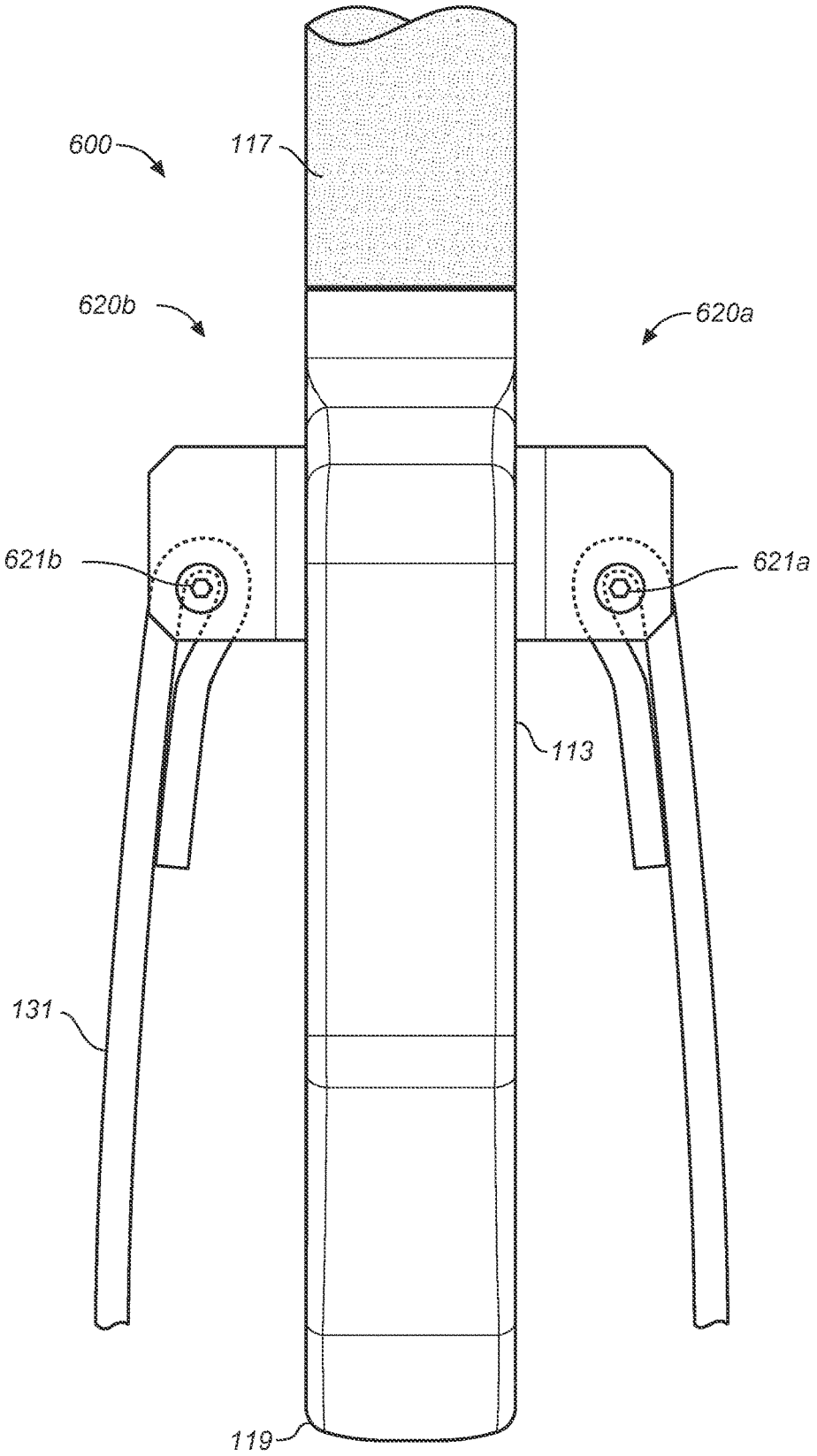
FIG. 7 is a side view of the device of FIG. 6.

FIGS. 6 and 7 are a back, side perspective view, and a side view, respectively of a second embodiment device 600 for massaging. Device 600 is generally similar to device 100, except as explicitly stated.

Device 600 of FIGS. 6 and 7 includes a pair of brackets 620*a* and 620*b* which support pins 621*a* and 621*b*, respectively. Pins 621*a* and 621*b* support belt 130, which includes a buckle 136 for adjusting the length of the belt. The operation of device 600 is similar to that of device 100, where a user places a body part between belt 130 and curved surface 119.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

I claim:

1. A method for massaging a user with a device that includes a body including a curved surface for contacting the user and a handle, and a strap having a length between a first end and a second end, where the first end and second end are connected to the body of the device, and a mechanism for adjusting the length of the strap, said method comprising the steps of:

placing the user between the body of the device and the strap between the first end and the second end, such that the strap and the curved surface of the device surrounds the user with the handle extending away from the user;

adjusting the length of the strap such that the curved surface and a portion of the strap between said first end and said second end are forced against and contact the user; and moving the handle in a plane perpendicular to the user, such that the portion of the curved surface contacting the user changes with the moving of the handle, and such that the strap and the curved surface provide a compressive force to the user.

2. The method of claim 1, wherein said step of placing includes inserting the user between the body of the device and the strap.

3. The method of claim 1, wherein said mechanism includes a buckle for accepting an end of the strap, and wherein said step of placing includes the steps of:

removing the end of the strap from the buckle, positioning the body of the device on the user;

placing the strap over the user, and inserting the end of the strap into the buckle.

4. The method of claim 1, wherein said step of placing includes positioning the curved surface against the user.

5. The method of claim 1, wherein:

said mechanism includes a buckle for accepting an end of the strap, and wherein said step of adjusting includes pulling the end of the strap to tighten the strap and curved surface against the user.

6. The method of claim 1, wherein said step of moving includes moving a position at which the curved surface contacts the user.

7. A method for massaging a user with a device that includes a body including a curved surface for contacting the user and a handle, and a strap having a length between a first end and a second end, where the first end and second end are connected to the body of the device, and a mechanism for adjusting the length of the strap, said method comprising the steps of:

inserting the user between the curved surface and the strap between the first end and the second end, such that the strap and the curved surface contact the user;

pulling the end of the strap to reduce the length of the strap and tighten the strap with the curved surface against the user; and moving the handle relative to the user, such that the portion of the curved surface contacting the user changes with the moving of the handle as the compressive force on the user from the curved surface is adjusted.

8. The method of claim 7, wherein said mechanism includes a buckle for accepting an end of the strap, and wherein said step of pulling includes the steps of:

removing the end of the strap from the buckle, positioning the body of the device on the user;

placing the strap over the user, and inserting the end of the strap into the buckle.

9. The method of claim 7, wherein said step of pulling includes positioning the curved surface against the user.

10. The method of claim 7, wherein said step of moving includes moving a position at which the curved surface contacts the user.

11. The method of claim 7, wherein said step of moving moves the curved surface in the plane perpendicular to an axis of the user.

* * * * *